US008789320B1

(12) United States Patent
Bradford

(10) Patent No.: US 8,789,320 B1
(45) Date of Patent: Jul. 29, 2014

(54) LARGE DISPLACEMENT ISOLATION BEARING

(71) Applicant: R. J. Watson, Inc., Alden, NY (US)

(72) Inventor: Paul Fred Bradford, West Falls, NY (US)

(73) Assignee: R. J. Watson, Inc., Alden, NY (US)

( * ) Notice: Subject to any disclaimer, the term of this patent is extended or adjusted under 35 U.S.C. 154(b) by 0 days.

(21) Appl. No.: 13/945,033

(22) Filed: Jul. 18, 2013

(51) Int. Cl.
*E04H 9/02* (2006.01)
*E02D 31/08* (2006.01)

(52) U.S. Cl.
CPC ..... *E04H 9/022* (2013.01)
USPC ..... 52/167.6; 52/167.8; 248/565; 248/636

(58) Field of Classification Search
USPC ..... 52/167.1, 167.4–167.9; 248/562, 565, 248/569, 570, 580, 582, 590, 600, 633, 636
See application file for complete search history.

(56) References Cited

U.S. PATENT DOCUMENTS 3,794,277 A * 2/1974 Smedley et al. ..... 248/548
4,117,637 A 10/1978 Robinson
4,187,573 A 2/1980 Fyfe et al.
4,320,549 A 3/1982 Greb
4,499,694 A 2/1985 Buckle et al.
4,593,502 A 6/1986 Buckle
4,599,834 A 7/1986 Fujimoto et al.
4,644,714 A 2/1987 Zayas
5,461,835 A 10/1995 Tarics
5,491,937 A 2/1996 Watson et al.
5,867,951 A 2/1999 Yaguchi et al.
6,021,992 A 2/2000 Yen et al.
6,107,389 A 8/2000 Oishi et al.
6,126,136 A 10/2000 Yen et al.
6,160,864 A 12/2000 Gou et al.
7,814,712 B2 * 10/2010 Tsai ..... 52/167.4
8,011,142 B2 9/2011 Marioni
2003/0167707 A1 9/2003 Tsai
2004/0045236 A1 3/2004 Kim
2006/0137264 A1 * 6/2006 Shizuku et al. ..... 52/167.7
2006/0174555 A1 8/2006 Zayas et al.
2008/0098671 A1 5/2008 Tsai
2011/0016805 A1 1/2011 Tsai

* cited by examiner

*Primary Examiner* — William Gilbert
(74) *Attorney, Agent, or Firm* — Jaeckle Fleischmann & Mugel, LLP

(57) ABSTRACT

The disclosed seismic isolation bearing includes an upper base plate, a lower base plate, a disc bearing core, and a shear spring surrounding the disc bearing core. Concave recesses are formed in a lower surface of the upper base plate and an upper surface of the lower base plate. The disc bearing core is centrally positioned with respect to the planes of the upper and lower base plates and can slide along the recesses of the upper and lower base plates, where the recesses exert a lateral return force on the disc bearing core when displaced from a central position. The shear spring surrounds the disc bearing core, deforms in shear upon lateral movement of the upper base plate relative to the lower base plate, and exerts a lateral return force on the upper base plate when the upper base plate is laterally displaced.

17 Claims, 6 Drawing Sheets

LARGE DISPLACEMENT ISOLATION BEARING

BACKGROUND OF THE INVENTION

Isolation bearings are used to add damping or increase a response period of a structure, such as a bridge. The five core performance functions of an isolation bearing are to transfer a vertical load, allow for large lateral displacements, produce a damping force, produce a spring restoring force, and allow for structure rotation. Two fundamental types of isolation bearings are used to accomplish these performance functions: sliding bearings and steel reinforced elastomeric bearings (SREB). Sliding bearings provide damping to a structure through frictional energy dissipation, but must include additional means to provide a restoring spring force. Elastomeric bearings provide restoring forces, but must include additional means to provide damping to the structure. Sliding isolators can incorporate springs to provide a restoring force. The isolation bearing disclosed in U.S. Pat. No. 5,491,937, for example, incorporates elastomeric compression springs. Upon displacement, both sliding and spring compression occurs, providing the necessary damping and restoring force requirements.

One drawback to sliding bearings with external springs is the space and cost required to fit the springs. Typically, compression springs can only be compressed to about 60% of their free length. At least one compression spring is required on each side of the bearing, meaning that the plan dimension of an isolator would be at least $L=B+(2d/0.6)=B+3.33d$, where L is the bearing plan dimension, B the load bearing element dimension, and d is the isolator seismic displacement. For small seismic displacements, this is typically not a severe limitation, but for large seismic displacements, the springs become overly-large and the bearing becomes too costly. In regions of high seismicity it is not uncommon to have seismic displacements of twelve inches and higher, resulting in bearing plan dimensions of forty-eight inches and larger. Another problematic characteristic of such a bearing is that the spring rate is usually inversely proportional to spring length and proportional to its cross sectional area. Thus, if a long spring is used to accommodate a large seismic displacement, its diameter has to be large or the spring will be too weak. Thus, large seismic displacements cause both of the bearing's plan dimension and height to grow.

U.S. Pat. No. 4,599,834 describes a system in which a steel-reinforced elastomeric bearing's (SREB) upper surface is permitted to slide relative to the super structure, i.e., in essence sliding on top of an SREB. The center core of the SREB houses a friction element that is preloaded with compression springs, such that when the SREB displaces, sliding friction occurs. The internal friction mechanism serves to boost damping, as SREBs are typically low-damping bearings. Due to size constraints the mechanical spring friction mechanism is limited in the amount of vertical load it can support, e.g., it is not uncommon for bridge bearing loads to exceed 1,000 tons. Hence, for structural bearing applications the majority of the vertical load in such a design must be supported by the SREB. Further, displacement in the design is constrained to the central annular region. Since large displacements require large clearances, the practical design range is limited to small vertical loads and small displacements (e.g., mechanical equipment applications or small pedestrian bridges).

U.S. Pat. No. 5,867,951 describes a design in which a sliding isolator is stacked on top of an elastomeric bearing isolator. This approach prevents the isolator from sticking in one place due to static friction, thus allowing the isolator to attenuate high frequency vibrations. Shortcomings of this approach include the cost of profiling the sliding surface and the increase in structure elevation due to lateral displacement of the isolator.

Elastomeric isolation bearings can use both internal and external means to provide damping to the structure. A common external approach incorporates a central lead plug, to form a lead rubber bearing, such as described in U.S. Pat. Nos. 4,117,637, 4,499,694, and 4,593,502. Lead rubber bearing isolators are a widely-used type of seismic isolator. Elastomeric bearings in conjunction with dampers and mild steel elements have also been used, as described in U.S. Pat. No. 6,160,864. The elastomer can also be compounded to increase its damping capabilities, as in the case of high damping rubber bearings, as described in U.S. Pat. No. 6,107,389, but the level of damping is usually limited to less than 20% damping for high displacement applications. Though rubber compounds exist with very high levels of damping, they exhibit high levels of creep, rendering them unsatisfactory for the vertical load performance function. A structure situated on a bearing with high creep properties would sag, leading to structural problems.

Sliding isolators can also use surface profiling of a sliding surface to provide a restoring force. The bearings disclosed in U.S. Pat. Nos. 4,320,549 and 4,644,714, for example, disclose sliding bearings that incorporate surface profiling. Surface profiling is an internal approach involving machining of a sliding surface such that it is not level. As the sliding bearing travels across the surface, the structure's elevation changes, which changes the potential energy of the structure, or in other words, its restoring force. The restoring force of the bearing disclosed in U.S. Pat. No. 4,644,714 is provided by the change in potential energy that occurs as its slider climbs up a curved surface profile of a concave bowl. The restoring force of the bearing disclosed in U.S. Patent Application Pub. No. 2004/0045236 is provided by orthogonal profiled tracks with a slide bearing consisting of back-to-back doublet sliding riders that slide in curved tracks. The restoring force of the bearing disclosed in U.S. Pat. No. 6,126,136 is provided by a spherical sliding bearing. The restoring force of the bearing disclosed in U.S. Pat. No. 8,011,142 is provided by two concave sliding surfaces with a two piece slider consisting of an upper sliding element and a lower sliding element that can pivot relative to each other.

Sliding bearings with such internal restoring force means (i.e., surface profiling) eliminate the problem of plan dimension growth due to spring lengths by eliminating the spring; however, there are problems with these types of bearings due to elevation change. During large displacements, large structure elevation changes can occur due to the sliding surface profiling. On a bridge structure, this can cause problems with vehicle ride-ability and expansion joints. Large elevation changes also means that the surface profiling has to be deep. A large displacement sliding isolator with surface profiling can involve high machining costs. Because there exist minimum restoring force requirements with such designs, and because elevation changes should be limited, at large displacements the maximum radius of the surface profiling of a standard double dish pendulum type isolator must be less than 352 inches. For even a 60 inch diameter dish, for example, the change in structure elevation will be at least 1.23 inches. For such an isolator, the minimum depth-to-diameter ratio of the surface profiling would be 1.23/60=0.021. These types of bearings suffer an additional drawback in that the load bearing element tends to be small to facilitate rotation performance, simplify construction, and decreases the size of the overall bearing, but a small bearing element means that the sliding material must be thin and strong, which results in the use of high strength composites. Thinner materials can support higher pressures, but they can burn at high velocities, and do not absorb dirt, debris, and rust particles very well.

For both types of sliding isolators, design and economic pressures drive effective spring rates downwards; thus, sliding isolators with higher displacements tend to have weak restoring forces, which is not a desirable characteristic. Restoring force issues aside, sliding bearings can be designed to accommodate high displacements by making the sliding surface larger. For SREBs, the problem is more complex. There are design limits on how much an elastomeric bearing can shear; if it displaces too much the isolator can buckle. One way to prevent this is to make the bearing larger in plan. But as the bearing grows in plan dimensions, it becomes stiffer in shear, and the height must be increased as well. Thus, the entire bearing grows. Another problem is that the axial compressive pressure decreases with increasing plan dimension; thus, lead rubber bearings require high pressures to help maintain lead core confinement.

SUMMARY OF THE INVENTION

The embodiments of the present invention eliminate many of the key shortcomings of previous isolator designs as detailed above. The embodiments disclosed herein are isolation bearings that are capable of accommodating large seismic displacements. The isolation bearings reduce seismic forces and accelerations transferred from the ground to buildings, bridges, and other types of structures. The bearings accomplish this by softening the otherwise rigid connection between structural supports and the portion of the structure to be isolated. Often this connection occurs on top of the foundations for buildings and on top of bridge substructure elements, such as piers and abutments.

One example seismic isolation bearing includes an upper base plate, a lower base plate, a disc bearing core, and a shear spring surrounding the disc bearing core. The upper and lower base plates each have an upper surface and a lower surface. A concave recess is formed in the lower surface of the upper base plate, and another concave recess is formed in the upper surface of the lower base plate. The disc bearing core is centrally positioned with respect to the planes of the upper and lower base plates and is in contact with the recess of the upper base plate and the recess of the lower base plate. The disc bearing core can slide along the recess of the upper base plate and the recess of the lower base plate, where the recesses exert a lateral return force on the disc bearing core when displaced from a central position. The shear spring surrounds the disc bearing core, is coupled to the lower surface of the upper base plate and the upper surface of the lower base plate, and deforms in shear upon lateral movement of the upper base plate relative to the lower base plate. The shear spring exerts a lateral return force on the upper base plate when the upper base plate is laterally displaced.

In many embodiments, the shear spring includes alternating layers of an elastomeric material and a substrate material, where the shear spring is configured to deform in shear along the layers of elastomeric material. In such embodiments, the height of each layer of elastomeric material may be high compared to the plan area of the layer. For example, the shape factor of each layer of elastomeric material may be less than a value of 1. Further, the height of each layer of substrate material may be smaller than the height of each layer of elastomeric material to provide added damping. In many embodiments, the elastomeric material is rubber and the substrate material is steel. Alternatively, the layers of substrate material may be made of another elastomeric material that is stiffer than the layers of elastomeric material. The shear spring may include an upper mounting plate configured to attached to the lower surface of the upper base plate, and a lower mounting plate configured to attached to the upper surface of the lower base plate.

In many embodiments, the disc bearing core includes an upper disc bearing plate, a lower disc bearing plate, and an elastomeric disc pad coupled between the upper disc bearing plate and the lower disc bearing plate. The disc bearing core may or may not include a shear pin at its center to prevent shearing of the disc bearing core. In many embodiments, the disc bearing core is configured to support all of a load on the seismic isolation bearing, and the shear spring is configured to not support any of the load. Alternatively, the shear spring may configured to support up to one third of a total load on the seismic isolation bearing. In some embodiments, a depth-to-diameter ratio of the recess of the lower base plate may be less than 0.01, and a depth-to-diameter ratio of the recess of the upper base plate may be less than 0.01.

Some embodiments may incorporate an upper support plate and an upper dish plate into the upper base plate, where an upper surface of the upper dish plate is coupled to a lower surface of the upper support plate, and where the recess of the upper base plate is formed in the lower surface of the upper dish plate. Similarly, a lower support plate and a lower dish plate may be incorporated into the lower base plate, where a lower surface of the lower dish plate is coupled to an upper surface of the lower support plate, and where the recess of the lower base plate is formed in the upper surface of the lower dish plate. In such embodiments, the shear spring may be coupled to the lower surface of the upper support plate and the upper surface of the lower support plate, where the shear spring surrounds the upper and lower dish plates.

Another example embodiment includes a centrally-located, high-load, multi-rotational, sliding bearing (HLMRB) sandwiched between concave recesses in upper and lower base plates, with a rubber shear spring (RSS) surrounding the HLMRB. The sliding HLMRB may be a disc bearing, though it can be composed of other HLMRB types (e.g., pot or spherical). This solves the problem of having to use a small, high pressure, sliding surface. A disc bearing works well due to its reliability and vertical vibration energy absorption capabilities. Vertical load is predominantly supported by the central sliding bearing, but the shear spring may take a lesser portion of the total vertical load. This provides design flexibility in specifying the level of friction damping; the more load the sliding bearing supports the higher the friction damping. In this embodiment, horizontal restoring force is provided by both the shear spring and the concave recesses of the base plates. Surface profiling of the recesses helps keep the sliding bearing centered and allows for different types of restoring force behavior as the restoring force characteristics may depend on the surface geometry (e.g., spherical or conical). Redundancy is introduced in that the restoring force performance function is not totally dependent upon the shear spring. This also allows for a shallow concave surface, reducing changes in structure elevation when the isolation bearing moves. In one embodiment, the isolation bearing can be designed such that the sliding bearing supports nearly all of the vertical load. In this case the shear spring is freed from many of the constraints placed upon elastomeric bearings. For example, a very high damping compound can be used because vertical load creep is no longer an issue. Further, the shear spring's geometry can be changed without concern to its load carrying capability, and for cases where the isolation bearing may experience uplift, the shear spring can be configured to optimize its design for tensile capacity (a load condition with which previous isolator designs struggle). The disc bearing core and shear spring are integrated into a compact isolation bearing design so as to reduce the footprint of the bearing, overcoming previous design limitations of excessive size. In addition, a box housing enclosure may provide environmental protection for the sliding surface, serving as a way to transfer both the sliding and restoring forces to the superstructure.

In summary, the embodiments disclosed herein eliminate many of the shortcomings experienced in current large displacement isolator designs through the use of an integrated sliding bearing core between concave recesses and a circumferential shear spring as disclosed herein.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
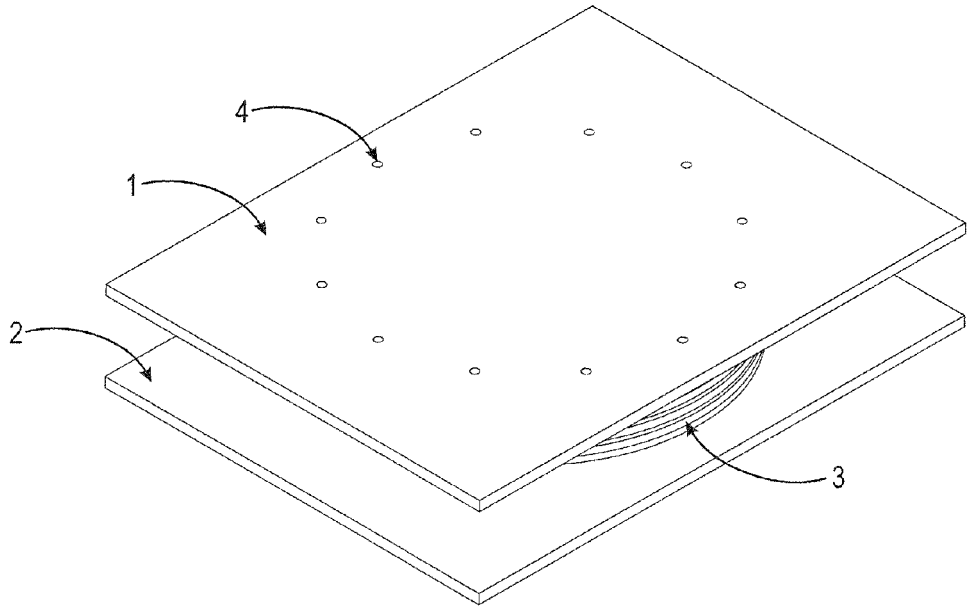
FIG. 1 is a schematic diagram showing an example embodiment of the seismic isolation bearing.

FIG. 1 is a schematic diagram showing an example embodiment of the seismic isolation bearing. The example embodiment includes a central sliding bearing core and a shear spring surrounding the disc bearing core. The disc bearing core and shear spring are positioned between an upper base plate 1 and a lower (bottom) base plate 2. Typically, the top of the upper base plate 1 is connected to a superstructure (the portion of a structure to be isolated), and the lower base plate 2 is connected to a substructure (e.g., foundation). Connections to the structure are not shown in the figures as the isolation bearing can be connected using standard methods. The shear spring 3 provides a restoring force to the isolation bearing and, in some embodiments, may support a part of the vertical load. The shear spring 3 may be connected to the upper base plate 1 using recessed bolt holes 4 that have been drilled through connection plate(s) (not shown) and bolts. The bottom of the shear spring 3 may be connected to the lower base plate 2 either by welding, for example, or bolt-through the bottom of the lower base plate 2. Thus, the top and bottom of the shear spring 3 can be firmly fixed to the upper base plate 1 and lower base plate 2, respectively.

Figure 2:
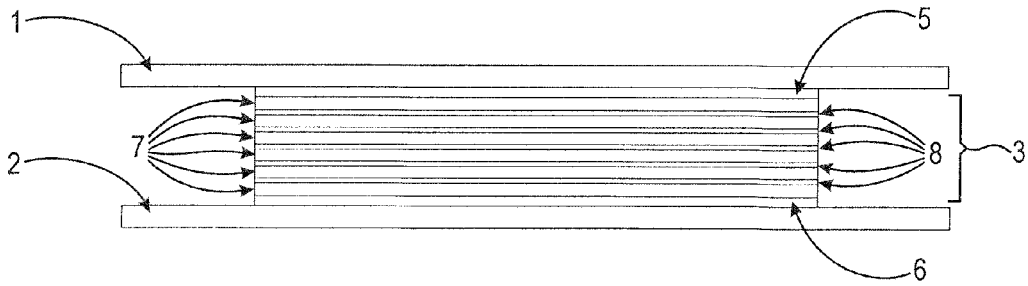
FIG. 2 is a schematic diagram showing an external elevation of the example embodiment of the seismic isolation bearing of FIG. 1.

FIG. 2 is a schematic diagram showing an external elevation of the example embodiment of the seismic isolation bearing of FIG. 1. The shear spring 3 is shown as being positioned between the upper base plate 1 and lower base plate 2. FIG. 2 shows example components comprising the shear spring 3. The example shear spring 3 includes intermittent layers of an elastomer 8 that are bonded to substrate layers 7. Suitable material for the elastomer layers 8 may be natural or synthetic rubbers, examples of which are, but not limited to, isoprene, silicone, neoprene, and polyurethane. The materials for the elastomeric layers 8 may vary from layer to layer. The function of the substrate 7 is to limit expansion at the interface to the elastomer layers 8 and, thus, material for the substrate 7 should be stiffer than the elastomer 8. In one example embodiment, the substrate material 7 may be made of steel, but alternate configurations could include other metals, as well as other stiff materials, such as composites, plastics, or even another elastomer that is stiffer than the elastomer layers 8. Rigid or semi-rigid substrate layers 7 encourage the elastomeric layers 8 to deform in shear rather than in tension; a more efficient use of the elastomer 8. If the desired restoring force for a particular application is small, the shear spring 3 may be designed with only one elastomeric layer 8, and no layers of substrate 7 would then be required. An upper mounting plate 5 and lower mounting plate 6 may act as connections to the upper base plate 1 and lower base plate 2, respectively.

The shear spring disclosed herein differs in a number of ways from standard steel reinforced elastomeric bearings (SREBs). Standard SREBs are used to support high vertical loads; thus, standard SREBs cannot be used to design the shear springs of the embodiments of the present invention. The present shear spring has an unusually-high aspect ratio (high rubber layer thickness) and type of elastomer. A high rubber thickness reduces the shape factor of the shear spring, which is the ratio of the loaded area (plan area) to the bulging area (elevation area) of the shear spring. In general, a high shape factor causes the rubber layer to be stiff in compression, which can be approximated by the equation $E_C=E\cdot(1+a\cdot S^2)$, where $E_C$ is the compressive modulus of a single rubber layer, E a material constant, a is a constant related to both material and geometry, and S is the shape factor. The shape factor S for a square or circular bearing may be represented by the equation $S=B/(4T)$, where B is the plan dimension and T is the thickness. The concept of a reduced vertical load on the present shear spring allows $E_C$ to be small, and it follows that S may be small as well, which allows the shear spring's layer thickness to be high. With such a shear spring, even moderate displacements across the thick layers can cause the shear spring elastomer and shim (substrate) layers to rotate, bend, or yield. In a reinforced elastomeric bearing setting, this could lead to catastrophic failure, as the bearing could buckle in such a position. The embodiments of the present invention, however, use a centrally-located sliding bearing, which prevents such failure. Thus, the isolation bearing disclosed herein can use a shear spring with a high elastomer thickness (reduced shape factor). Thus, the present shear spring is unencumbered by a vertical load support requirement and can, thus, be designed using unique materials and methods, performing in ways not possible with standard SREBs.

Figure 3:
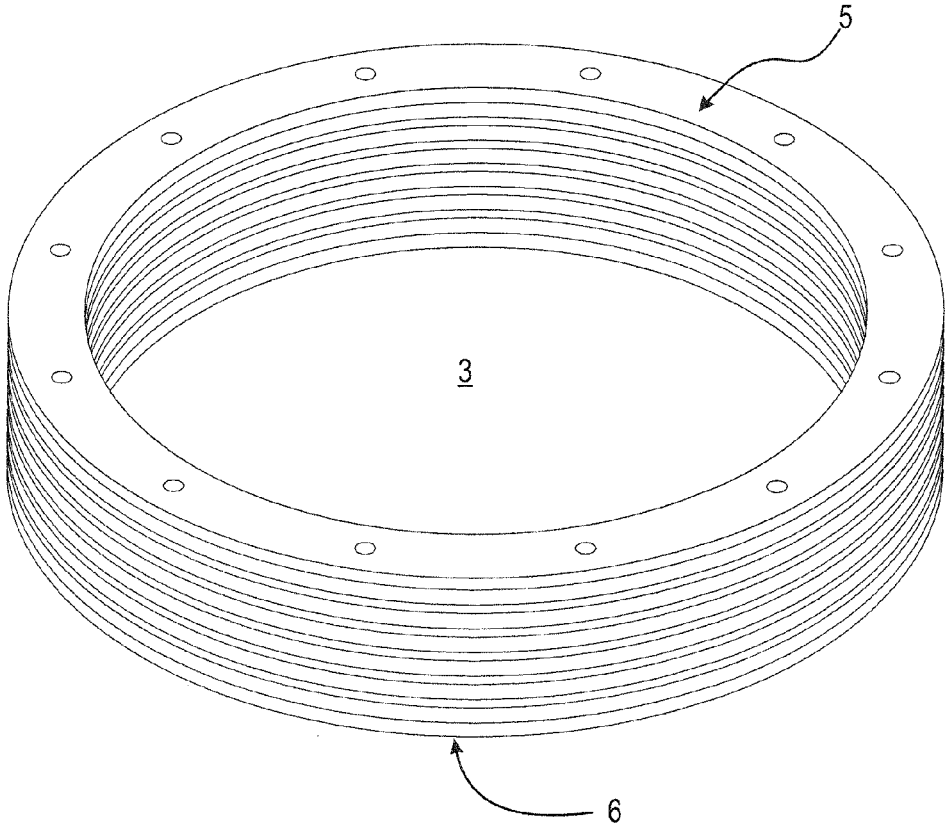
FIG. 3 is a schematic diagram showing an example embodiment of a shear spring that may be used in the seismic isolation bearing.

FIG. 3 is a schematic diagram showing an example embodiment of a shear spring 3 that may be used in the seismic isolation bearing. FIG. 3 shows the alternating elastomer and substrate layers, an upper mounting plate 5, and a lower mounting plate 6. For clarity, the upper and lower base plates are not shown.

Figure 4:
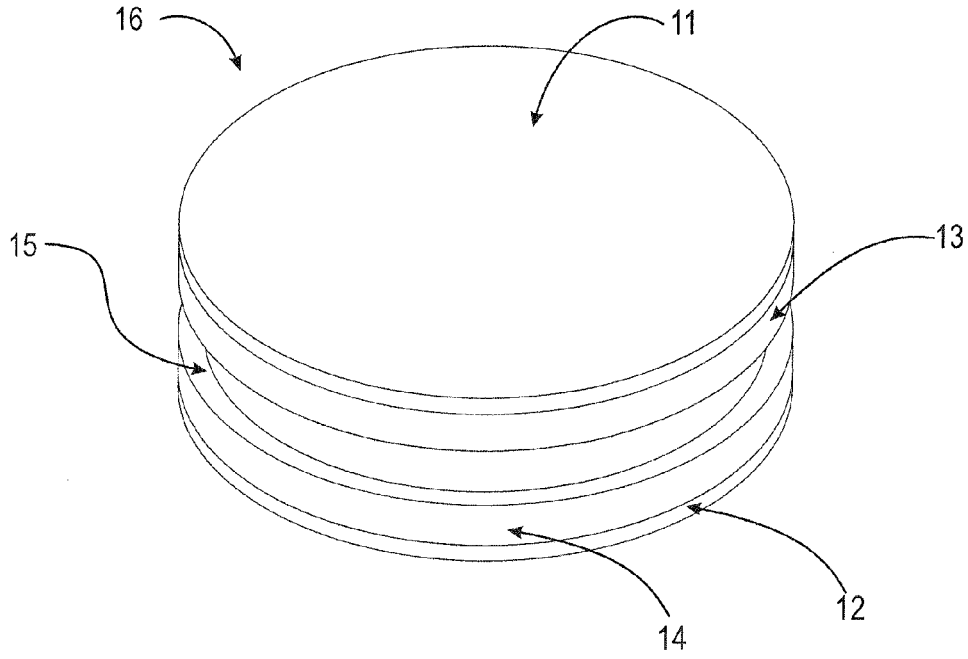
FIG. 4 is a schematic diagram showing an example embodiment of a disc bearing core that may be used in the seismic isolation bearing.
Figure 6:
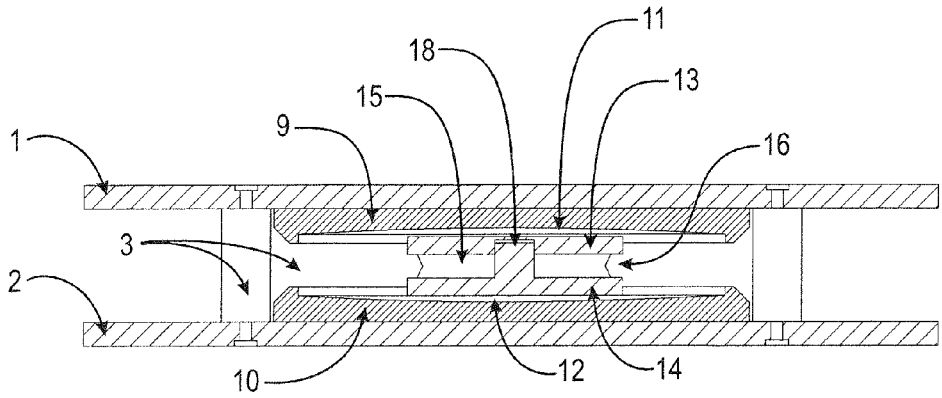
FIG. 6 is a schematic diagram showing a section view of the seismic isolation bearing of FIG. 1.

FIG. 4 is a schematic diagram showing an example embodiment of a disc bearing core 16 that may be used in the seismic isolation bearing. The sliding bearing core 16 may consist of an elastomeric disc 15 sandwiched between an upper bearing plate 13 and a lower bearing plate 14. An optional internal shear pin 18 (FIG. 6) may prevent shear deformation of the sliding bearing core 16. Attached to the upper bearing plate 13 is an upper sliding rider 11. The upper sliding rider 11 slides against an interior surface of the upper base plate or upper dish plate 9 (FIG. 6). Attached to the lower bearing plate 14 is a lower sliding rider 12. The lower sliding rider 12 slides against an interior surface of the lower base plate or lower dish plate 10 (FIG. 6). The upper and lower sliding riders 11, 12 may be composed of any number of friction rider materials. Suitable materials that that may be used for the sliding riders 11, 12 are, for example, PTFE (polytetrafluoroethylene), woven PTFE, bronze, fiber composites, and plastics, such as nylon and ultra-high molecular weight polyethylene (UHMW).

Figure 5:
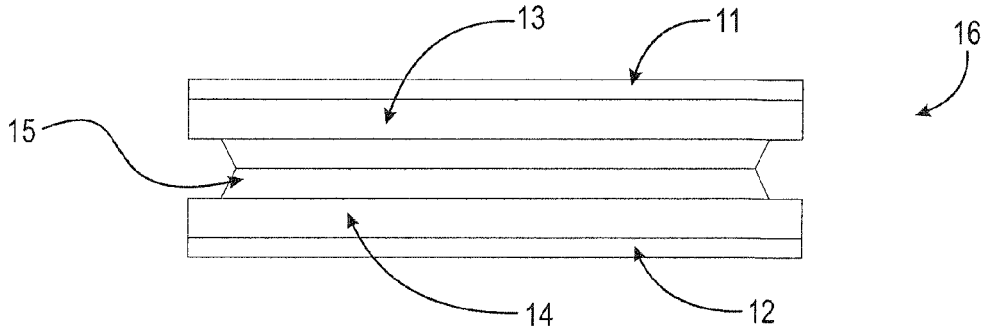
FIG. 5 is a schematic diagram showing an elevation of the disc bearing core of FIG. 4.

FIG. 5 is a schematic diagram showing an elevation of the disc bearing core 16 of FIG. 4. FIG. 5 shows the elastomeric disc 15, upper bearing plate 13, lower bearing plate 14, upper sliding rider 11, and lower sliding rider 12.

FIG. 6 is a schematic diagram showing a section view of the seismic isolation bearing of FIG. 1. The upper base plate 1, lower base plate 2, shear spring 3, upper dish plate 9, lower dish plate 10, elastomeric disc 15, upper bearing plate 13, lower bearing plate 14, upper sliding rider 11, lower sliding rider 12, and shear pin 18 are visible.

Figure 7:
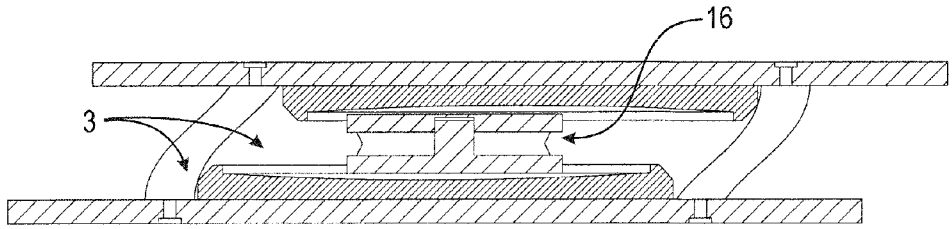
FIG. 7 is a schematic diagram showing a section view of the seismic isolation bearing of FIG. 1 in a displaced position.

FIG. 7 is a schematic diagram showing a section view of the seismic isolation bearing of FIG. 1 in a displaced position. When the isolation bearing is displaced, the elastomeric spring ring 3 resists movement elastically, providing a restoring force. The isolation bearing is displaced in the longitudinal direction ('x' units). The restoring force cause by the displacement is equal to the force across the displaced shear spring(s), $F_R=k\cdot x$, where k is the total shear spring effective spring rate for the isolation bearing. While moving with velocity v the dissipative force is $F_D=\mu\cdot W+F_{RBS}$, where μ is the sliding coefficient of friction, W is the vertical load on the isolation bearing, and $F_{IBS}$ is the total damping force of the shear spring(s). The total force across the isolation bearing in the longitudinal direction is the sum of the restoring force and damping components, $F=F_R+F_D$.

In addition, because of the profiling on the interior of the bearing, the height of the structure changes. The increase in potential energy is equal to D·h, where D is the dead load on the isolator and h is the height that the structure has been raised by the isolator. The total spring force of the isolator is F=dE/dx, where E is the potential energy stored in the elastomeric spring 3 due to the change in structure height. The sliding disc bearing's 16 position between the dish plates 9, 10 is that which minimizes the potential energy of the system. If the upper dish plate 9 and lower dish plate 10 are profiled the same, then the sliding disc bearing 16 may be displaced equally with respect to both dishes. An advantage to profiling both the upper dish 9 and the lower dish 10 is that the two dishes share in the total displacement of the isolator, allowing for smaller plan view dimensions and reducing cost.

Figure 8:
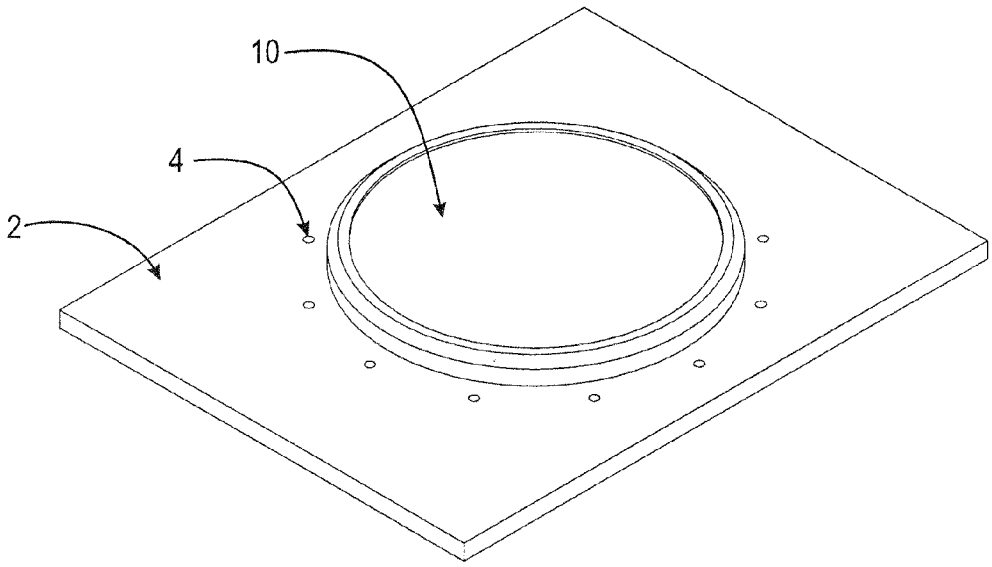
FIG. 8 is a schematic diagram showing an example lower dish plate that may be used in the seismic isolation bearing.

FIG. 8 is a schematic diagram showing an example lower dish plate that may be used in the seismic isolation bearing. Lower sliding rider 12 (FIG. 6) slides inside a recess 17 (FIG. 9) of the lower dish plate 10. The inside of the lower dish plate 10 is profiled so as to produce a recessed concave interior profile. The bottom of the lower dish plate 10 is affixed to the upper surface of the lower base plate 2. A similar arrangement may exist for the upper dish plate 9 (FIG. 6). Examples of profiled surfaces include partial spherical and conical shapes, but many other shapes can be machined into the dish plates 9, 10. The upper dish plate 9 and lower dish plate 10 interior profiles need not be the same. In some embodiments, the recess formed by the profiling of the dish plates can, instead, be machined directly into the upper or lower base plates, thus, eliminating the need for dish plates. As explained above, the maximum radius of a standard double dish pendulum type isolator must be less than 352 inches. No such maximum radius requirement exists for the isolator embodiments disclosed herein because the restoring force is also supplied in part by the shear spring. Thus if a ⅜ inch depth is used for a 60 inch diameter recess, the height-to-diameter ratio of the recess would be 0.375/60=0.006. Thus, the height-to-diameter ratios for the isolator embodiments disclosed herein can be a fraction of that used in standard pendulum type isolators, serving to reduce machining costs as well as structure elevation changes.

Figure 9:
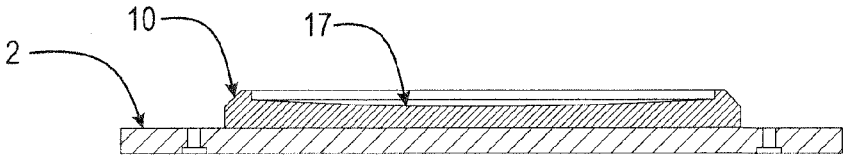
FIG. 9 is a schematic diagram showing an external elevation of the example lower dish plate of FIG. 8.

FIG. 9 is a schematic diagram showing an external elevation of the example lower dish plate of FIG. 8. The lower base plate 2, lower dish plate 10, and recess 17 are visible.

Figure 10:
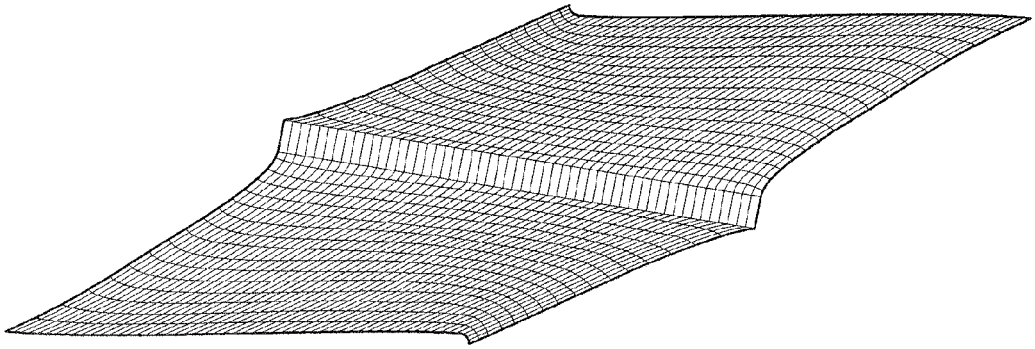
FIG. 10 is a cross-section of an example shear spring showing tilting of the substrate material upon deformation.

FIG. 10 is a cross-section of an example shear spring showing tilting of the substrate material upon deformation. Rotation of shear spring internal shims (substrate layers) can cause tensile stresses in the elastomeric layers, a stress mode known to cause sudden failure. This also has the effect of reducing the restoring force spring rate. Finite element analysis can be used check these two effects. FIG. 10, for example, shows the rotation that may occur when a shear spring is displaced in the short direction. Upon displacement, a bending moment exists on the internal shims. If the shims are made thin, or of a soft material (e.g. copper, bronze, mild steel, lead), they can yield and, in effect, can act as internal dampers. Isolation bearing damping can also be enhanced by incorporating nontraditional rubber type materials, for example, rubber foams and viscous materials.

While this invention has been particularly shown and described with references to example embodiments thereof, it will be understood by those skilled in the art that various changes in form and details may be made therein without departing from the scope of the invention encompassed by the appended claims.

What is claimed is:

1. A seismic isolation bearing comprising:

an upper base plate having an upper surface and a lower surface, the lower surface of the upper base plate having a concave recess formed therein;

a lower base plate having an upper surface and a lower surface, the upper surface of the lower base plate having a concave recess formed therein;

a disc bearing core centrally positioned with respect to the planes of the upper base plate and lower base plate, the disc bearing core being in contact with the recess of the upper base plate and the recess of the lower base plate, and configured to slide along the recess of the upper base plate and to slide along the recess of the lower base plate, the recesses exerting a lateral return force on the disc bearing core when displaced from a central position; and a shear spring surrounding the disc bearing core, the shear spring (i) being coupled to the lower surface of the upper base plate and the upper surface of the lower base plate, and being configured to deform in shear upon lateral movement of the upper base plate relative to the lower base plate, and to exert a lateral return force on the upper base plate when the upper base plate is laterally displaced, and (ii) including alternating layers of an elastomeric material and a substrate material, the shear spring being configured to deform in shear along the layers of elastomeric material, and each layer of elastomeric material having a shape factor that does not exceed a value of 1.

2. A seismic isolation bearing as in claim 1 wherein a height of each layer of substrate material is smaller than the height of each layer of elastomeric material to provide added damping.

3. A seismic isolation bearing as in claim 1 wherein the elastomeric material is rubber and the substrate material is steel.

4. A seismic isolation bearing as in claim 1 wherein the layers of substrate material are configured to yield upon lateral deflection of the at least one shear spring to provide added damping.

5. A seismic isolation bearing as in claim 1 wherein the layers of substrate material are made of another elastomeric material that is stiffer than the layers of elastomeric material.

6. A seismic isolation bearing as in claim 1 wherein the shear spring includes an upper mounting plate configured to be attached to the lower surface of the upper base plate, and includes a lower mounting plate configured to be attached to the upper surface of the lower base plate.

7. A seismic isolation bearing as in claim 1 wherein the disc bearing core is configured to support all of a load on the seismic isolation bearing, and the shear spring is configured to not support any of the load on the seismic isolation bearing.

8. A seismic isolation bearing as in claim 1 wherein the shear spring is configured to support less than one third of a total load on the seismic isolation bearing.

9. A seismic isolation bearing as in claim 1 wherein a depth-to-diameter ratio of the recess of the lower base plate is less than 0.01.

10. A seismic isolation bearing as in claim 9 wherein a depth-to-diameter ratio of the recess of the upper base plate is less than 0.01.

11. A seismic isolation bearing as in claim 1 wherein the disc bearing core includes:

an upper disc bearing plate;

a lower disc bearing plate; and an elastomeric disc pad coupled between the upper disc bearing plate and the lower disc bearing plate.

12. A seismic isolation bearing as in claim 1 wherein the upper base plate includes an upper support plate and an upper dish plate, an upper surface of the upper dish plate being coupled to a lower surface of the upper support plate, and the recess of the upper base plate being formed in the lower surface of the upper dish plate.

13. A seismic isolation bearing as in claim 12 wherein the shear spring is coupled to the lower surface of the upper support plate and surrounds the upper dish plate.

14. A seismic isolation bearing as in claim 1 wherein the lower base plate includes a lower support plate and an lower dish plate, a lower surface of the lower dish plate being coupled to an upper surface of the lower support plate, and the recess of the lower base plate being formed in the upper surface of the lower dish plate.

15. A seismic isolation bearing as in claim 14 wherein the shear spring is coupled to the upper surface of the lower support plate and surrounds the lower dish plate.

16. A seismic isolation bearing as in claim 1 wherein the disc bearing core includes a shear pin at the center of the disc bearing core to prevent shearing of the disc bearing core.

17. A seismic isolation bearing as in claim 1 wherein the disc bearing core does not include a shear pin.

* * * * *